United States Patent [19]

Duit

[11] Patent Number: 4,847,116

[45] Date of Patent: Jul. 11, 1989

[54] METHOD FOR DEPOSITING PARTICLES AND A BINDER SYSTEM ON A BASE FABRIC

[75] Inventor: William H. Duit, Rensselaer, N.Y.

[73] Assignee: Albany International Corp., Albany, N.Y.

[21] Appl. No.: 191,440

[22] Filed: May 9, 1988

[51] Int. Cl.[4] ..... B05D 3/02; B32B 5/16

[52] U.S. Cl. ..... 427/195; 156/283; 427/373; 427/389; 428/240; 428/283; 428/296

[58] Field of Search ..... 427/244, 389, 195, 373; 428/240, 283, 296; 156/283

[56] References Cited

U.S. PATENT DOCUMENTS 4,357,386 11/1982 Lueianu et al. ..... 428/240 X 4,571,359 2/1986 Dutt ..... 156/283 X

*Primary Examiner*—Michael Lusigman

*Attorney, Agent, or Firm*—Kane, Dalsimer, Sullivan, Kurucz, Levy, Eisele & Richard

[57] ABSTRACT

This invention consists of a method to produce a composite wet-press papermakers felt by which one side of a textile base fabric can be given a uniform, smooth coating of polymeric resin particles fused together to provide a porous, elastic surface. Its distinguishing feature is the application to the textile base fabric of a homogeneous foam, composed of resin particles, a binder material, and a solvent, in a uniformly thick coating. The textile base fabric is then subjected to heat, which evaporates the solvent and fuses the resin particles to each other and to the fabric base.

1 Claim, 1 Drawing Sheet

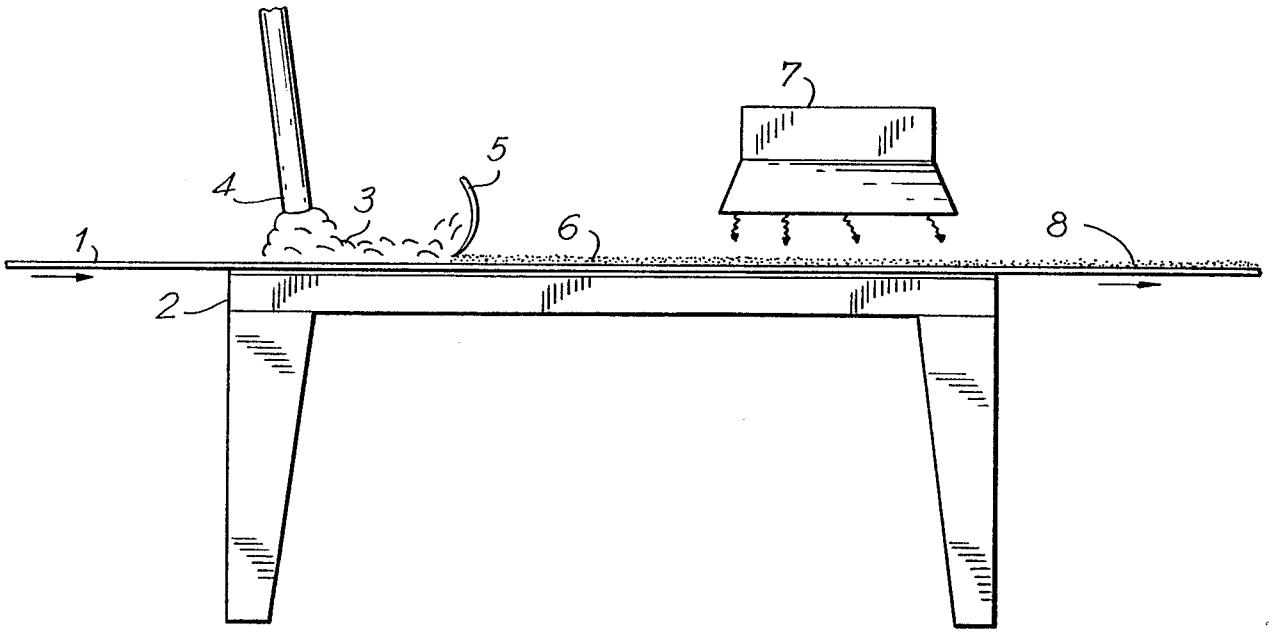
1
2
3
4
5
6
7
8

METHOD FOR DEPOSITING PARTICLES AND A BINDER SYSTEM ON A BASE FABRIC

BACKGROUND OF THE INVENTION

1. Field of the Invention

This invention relates to the manufacture of water-absorbent clothing or felt used on papermaking machines. More specifically, it involves a method by which a uniform layer of polymeric resin particles can be applied to the surface of a textile base fabric and fused to provide a porous, elastic surface.

2. Description of the Prior Art

One of the key components of a modern papermaking machine is the water-absorbent machine clothing or felt. These so-called felts take the form of endless belts of considerable size, and are custom-made according to specifications, supplied by the papermaker, which include the dimensions of the belt required to clothe a particular machine position and the kind of paper the machine produces.

The felts used in the press section of a papermaking machine concern us here. There, the felts serve at least two important purposes, as they both support the wet fibrous sheet as it is being transformed into the finished paper product and absorb water from that sheet in great quantities.

This can be better understood if one views the press section in terms of its relationship to the other sections of the papermaking machine. The first section, immediately before the press section, is the forming section, where the wet fibrous sheet is formed by spraying an aqueous suspension of wood pulp fiber on a fine screen or wire. A great deal of water will drain out of the sheet in this stage, but water will still account for a major proportion of its weight as it reaches the end of the forming section. As a result, the sheet has little structural integrity at this point, and will require support if it is not to break and cause machine operating problems.

From the forming section, the sheet proceeds to the press section. There, the press felts provide the necessary support to the sheet as it makes its passage through the presses, where additional large quantities of water are squeezed out. Many papermachine press sections incorporate two or more such felts, and, quite often, the wet sheet will be carried or sandwiched between two felts as it makes its journey through the section. In any case, it is in the press nip, the narrow region between the press rolls where compression occurs, that the felt carries out the function of absorbing the water squeezed out of the wet sheet.

It is important, from the standpoint of economics, that the felt be capable of removing as much water as possible during the transit of the sheet through the press section. This is so because, after leaving that section, the sheet enters the dryer section, where whatever water that remains is evaporated through the use of heated rolls. Costs associated with this heating will be reduced when optimum quantities of water are absorbed by the felt in the press section, as less water will have to be removed in the dryer section.

Up until fairly recently, wool was the basic raw material used in the production of press felts. As the term "felt" suggests, one of the final steps in the production of these machine belts was that of felting, in which the woven woolen fabric was wet and subjected to rubbing in order to produce a belt having a smooth surface.

Today, however, with the advent of a great variety of synthetics, wool has largely fallen out of use.

Contemporary synthetics carry the advantages of greater strength, durability, and resistance to chemical and bacterial attack when compared to woolen felt. The term "felt", strictly speaking, is no longer applicable to these fabrics as they cannot be felted in the literal sense. Instead, alternate manufacturing steps are taken during their production to give them surface characteristics and finish similar to those of true felt. For example, the so-called batt-on-base felts, currently in wide use and considered the standard of the industry, consist of a woven fabric base with a batt surface attached by needling and have surface characteristics similar to those of woolen felt. In addition, a wide variety of other constuctions are available, including non-woven press felts. Yet, despite the complete absence of wool and traditional felting processes during production, they are still commonly, if not universally, referred to as "felts" in the papermaking industry.

Press felt are characterised by such factors as fiber variety, weave type, permeability, and surface characteristics. The choice of felt to be used on any given machine is governed by the machine design and operating parameters, the grade of paper being produced and the desired surface finish.

As noted above, there are alternatives available for use instead of the popular batt-on-base press felts. For example, U.S. Pat. No. 4,571,359 entitled "Paperpermaker's Wet-Press Felt and Method of Manufacture", disclosed a novel papermaker's felt composed of a textile base fabric having a surface layer of polymeric resin particles fused together to provide a porous, elastic surface. In practice, however, it has proven difficult to apply the resin particles in a manner that will leave them uniformly and evenly distributed on the surface of the base fabric. The present invention is addressed to solving that problem.

SUMMARY OF THE INVENTION

It is the purpose of this invention to provide a means for distributing the resinous particles and a binder system evenly onto the base fabric of a press felt. Alternatively expressed, this invention comprises a method for manufacturing the papermakers wet-press felt disclosed in U.S. Pat. No. 4,571,359.

The method comprises the application of a homogeneous foam or froth of polymeric resinous particles, a binder material, and suitable solvent to the surface of the fabric. The foam, homogenous with rspect to its internal distribution of resin particles, is of sufficiently thick consistency to be smoothed and levelled by means of bars or blades in order that the fabric be coated with a uniformly thick layer. The foam, then, merely constitutes the means of distribution of the resin particles on the surface of the base fabric. Heat would then be applied, evaporating the solvent component of the foam or froth and leaving behind the resinous particle structure uniformly deposited and fused together on the surface of the fabric.

One of the critical parameters with regard to the homogeneous foam is its viscosity, which must be of a degree that bleed through the fabric structure can be avoided. In this way, all of the polymeric particulate material will be retained on the surface of the fabric.

BRIEF DESCRIPTION OF THE DRAWING

FIG. 1 depicts one mode by which the disclosed method can be put into practice.

DESCRIPTION OF THE PREFERRED EMBODIMENT

FIG. 1 shows a textile base fabric 1 in the process of being coated according to the method of this invention. It is assumed that this base fabric 1 is being maintained in a taut and flat condition and is being moved along in the direction indicated by the arrow by some suitable means not shown.

In order to ensure that the coating being applied to the base fabric 1 be of uniform thickness, the method incorporates the use of a horizontal surface 2 that supports the base fabric 1 from below, i.e., from the side not being coated, during the entire process. In this way, sag in the base fabric will be avoided and the foam will be deposited in a uniformly thick layer.

The foam 3 of polymeric resinous particles, binder material, and solvent, homogenized and stored in an apparatus not shown, is applied to the base fabric 1 through a suitable outlet 4. The polymeric resinous particles can be as described in U.S. Pat. No. 4,571,359, that is, they should have an average diameter in the range from approximately 0.15 mm to 5 mm. The preferred size is about 0.5. mm. By selecting the size of the particles and their distribution as they are deposited on the base fabric, the final void size and distribution on the wet-press felt of the invention can be controlled. Representative of the polymeric resins are polyolefins such as polyethylene, polyurethanes, including polyether and polyester polyurethanes and the like. The binder material can be high-temperature resistant resins, such as polyamide and polyimide resins, which are applied as liquids and which cure to a solid film under heat. Water is quite suitable for use as the solvent, although others could serve equally well.

A levelling blade 5, oriented in such a way to push excess foam 3 from the base fabric 1, distributes the foam 3 smoothly and evenly upon the surface of the base fabric 1 in a layer of uniform thickness.

The evenly coated base fabric 6 next passes beneath a heat source 7, which evaporates the solvent in the foam 3, and fuses the particles of polymeric resin to each other and to the base fabric 1. The processing temperature of the heat source should be high enough to soften the polymeric resin particles, but below a degradative temperature. This will also cure the binder material, and, as noted above, evaporate the solvent. The finished product (8), a belt having a porous, elastic surface, emerges from beneath the heat source 7 at the extreme right of the figure.

What is claimed is:

1. A method of manufacturing a composite wet-press felt fabric, which comprises:

providing a wet-press felt base fabric of interwoven machine direction and cross-machine direction yarns;

depositing a homogeneous foam of polymeric resin particles, binder material; and a solvent on a surface of the base fabric;

distributing the foam on the surface of the base fabric in a uniformly thick layer; and applying a heat treatment to the base fabric to evaporate the solvent in the foam, to fuse the polymeric resin particles to each other and to the base fabric, and to cure the binder material.

* * * * *

UNITED STATES PATENT AND TRADEMARK OFFICE

CERTIFICATE OF CORRECTION

PATENT NO. : 4,847,116

DATED : July 11, 1989

INVENTOR(S) : William H. Dutt

It is certified that error appears in the above-identified patent and that said Letters Patent is hereby corrected as shown below:

Cover page, Item [19], delete "Duit" and substitute therefor --Dutt--;

Cover page, Item [75], delete "Duit" and substitute therefor --Dutt--.

Signed and Sealed this

Tenth Day of April, 1990

*Attest:*

HARRY F. MANBECK, JR.

*Attesting Officer*

*Commissioner of Patents and Trademarks*